US011944164B2

(12) United States Patent
Ferrari

(10) Patent No.: US 11,944,164 B2
(45) Date of Patent: Apr. 2, 2024

(54) DEVICE CLAMPING, MULTI-PURPOSE, WITH REMOVABLE, INTERCHANGEABLE AND CUSTOMIZABLE PLATE

(71) Applicant: Gianluca Ferrari, Piverno (IT)

(72) Inventor: Gianluca Ferrari, Piverno (IT)

( * ) Notice: Subject to any disclaimer, the term of this patent is extended or adjusted under 35 U.S.C. 154(b) by 0 days.

(21) Appl. No.: 17/622,857

(22) PCT Filed: Jun. 12, 2020

(86) PCT No.: PCT/IT2020/050149
§ 371 (c)(1),
(2) Date: Dec. 26, 2021

(87) PCT Pub. No.: WO2020/261304
PCT Pub. Date: Dec. 30, 2020

(65) Prior Publication Data

US 2022/0240631 A1 Aug. 4, 2022

(30) Foreign Application Priority Data

Jun. 27, 2019 (IT) ..... 102019000010206

(51) Int. Cl.
*A44B 17/00* (2006.01)
*A44B 1/32* (2006.01)
*A43B 3/00* (2022.01)

(52) U.S. Cl.
CPC ..... *A44B 17/0005* (2013.01); *A44B 1/32* (2013.01); *A43B 3/0078* (2013.01); *A44B 17/0082* (2013.01)

(58) Field of Classification Search
CPC ... A44B 17/0005; A44B 1/32; A44B 17/0082; A44B 11/2588; A43B 3/0078; F16B 21/02; A44C 5/18
See application file for complete search history.

(56) References Cited

U.S. PATENT DOCUMENTS 3,611,513 A * 10/1971 Hoober ..... A44C 5/2052 24/658
3,643,296 A * 2/1972 Kahn ..... A44B 1/28 24/108

(Continued)

OTHER PUBLICATIONS

International Search Report, PCT/IT2020/050149, WO2020261304, dated May 11, 2020.

(Continued)

*Primary Examiner* — David M Upchurch
(74) *Attorney, Agent, or Firm* — Law Office of John K. Pike, PLLC

(57) ABSTRACT

A mechanical closure and fastening device, having a first part (1), made of a plate with a pin (1A) extending therefrom, the pin having first and second shaped sections in registry alignment and a narrower engaging section therebetween; and a second part (2), made of three plates (2A), (2B) and (2C), joined together, each having an opening in registry alignment and shaped to receive the first and second shaped sections when the pin is inserted thereinto; wherein plate (2B) has a rotatable plate within a fixed housing and having a lever (3) with which the rotatable plate may be rotated between an open position and a tightened, locked position within the housing, wherein in the tightened, locked position the opening in the rotatable plate is rotated out of registry alignment with the openings in plates (2A) and (2C); and wherein when the rotatable plate is in the open position, and the pin (1A) is inserted into the openings, the first and second shaped sections of pin (1A) are fixedly engaged by the openings in plates (2A) and (2C), and the engaging section therebetween is aligned with the opening in plate (2B), the rotatable plate may be rotated with the lever (3) about the engaging section to the tightened, locked position to thereby capture the first shaped section and lock the first and second parts (1) and (2) together.

7 Claims, 6 Drawing Sheets

(56) References Cited

U.S. PATENT DOCUMENTS

| | | | | | |
|---|---|---|---|---|---|
| 3,765,064 | A * | 10/1973 | Hoober | A44C 5/2052 | 24/658 |
| 5,018,901 | A * | 5/1991 | Ferree | B64G 1/641 | 403/349 |
| 7,698,836 | B2 * | 4/2010 | Schmelzer | A43B 3/0078 | 36/137 |
| 9,482,491 | B1 * | 11/2016 | Luster | F41H 5/013 | |
| 2008/0060110 | A1 * | 3/2008 | Schmelzer | A44B 1/32 | 2/69 |
| 2008/0155788 | A1 * | 7/2008 | Wilcox | A43B 23/24 | 24/3.1 |
| 2015/0292541 | A1 * | 10/2015 | Risdale | F16B 19/002 | 29/525.01 |
| 2018/0199677 | A1 * | 7/2018 | Steinke, II | A44B 17/0023 | |

OTHER PUBLICATIONS

Written Opinion, PCT/IT2020/050149, WO2020261304, dated Dec. 30, 2020.

International Preliminary Report on Patentability, PCT/IT2020/050149, WO2020261304, dated Dec. 28, 2021.

* cited by examiner

DEVICE CLAMPING, MULTI-PURPOSE, WITH REMOVABLE, INTERCHANGEABLE AND CUSTOMIZABLE PLATE

TECHNICAL FIELD OF THE INVENTION

The object of the present invention is a multipurpose and customizable mechanical devise with technical function of tightening closure structured to create articles and fashion accessories and/or objects for domestic and industrial use.

The identified technical field of the invention is that of closing devise similar to buttons and diskettes of different shape, size and material, having two parts, one of which with a pin and another with an housing, which, once superimposed on each other, can be closed by means of pressure or once superimposed on each other they must rotate one over the other to allow interlocking closure like the classic bayonet closures.

Instead the present invention concerns a mechanical device of tightening closure consisting of two parts of which: one of the two is composed of a plate that contains a pin (1A), the other part (2) is necessarily structured of minimum three plates with housing (2A, 2B, 2C) superimposed on each other, as to form a single part of housing and suitable for incorporating the pin (1A); the central plate (2B) in structured with a lever (4), that allows the rotation of this plate up to the stop generating the locking mechanism of the two parts, also possibly with the help of a spring (4), simply by superimposing the same and without rotating each other.

With this invention, a tightening closure can be guaranteed without one of the two parts and/or diskettes must rotate one with respect to the other, guaranteeing a new technical function of tightening closure between two completely safe parts.

BACKGROUND ART

Several buttons or diskettes, of shape, size and different materials, having types of locking and/or pressure closure applied with decorative functionality on clothes and to wearable objects of daily use which have characteristics and functions completely different from those of the present invention.

Infect, the buttons or disks known to the background art meet both limits linked to the practicality of fixing the two parts of the device, not always easy, requiring the rotation of one part with respect to the other in order to allow the tightening of the parts themselves, and limits related to the practicality of the attachment, requiring a pressure fit, of the two parts which does not guarantee a proper secure seal and is not comfortable to operate.

In particular, with the buttons and/or disks of the prior art, the pressure closure does not guarantee a secure seal, and the interlocking one can be applied by turning the two parts of the button and/or the disk each with respect to the other, preventing the technical and decorative features of the new invention from the device.

Devices such as those listed in the research report (U.S. Pat. No. 3,643,296 A, registered in the United States by KAHN EDWARD JOEL, 22 Feb. 1972; N. 2008/060110 A1, registered in the United States by SCHMEZEL RICHARD, 13 Mar. 2008; N. 2008/155788 A1, registered by WILCOX ROBERT, 3 Jul. 2008), are all completely different. They have a part having a pin and a part having a one-piece housing which, once joined, must rotate one relative to the other in order to allow the closure of the both parties.

Therefore, these known patents are presented as classic closures that work with snap or pressure interlocking (bayonet locks) and do not have the technical characteristics of the Applicant's invention, i.e. a housing part which incorporates at least three plates inside of which the central one has a lever connected to it which rotates independently of the parts of the device and generates the locking closure of the same.

In fact, the bayonet lock meets the limits of the rotation of the two parts of the object to be joined which, if done in the opposite direction, would release them.

Moreover the buttons or disks known to the state of the art in addition, not offer possibility to interchange a part of the device in an easy, practical, fast and safe way, therefore allowing a series use with multiple objects.

Finally, the patent known in the state of the art, for example bayonet closures, do not allow to be used to fix articles and/or objects of daily, domestic and industrial use, with multiple anchoring points, since the superimposing of one plate on the other one would force the object to necessarily rotate, with evident inconvenience in the practicality of the action.

DISCLOSURE OF INVENTION

The purpose of this invention, instead, is to realize a multipurpose and customizable mechanical device of tightening closure that have a double functionality, technique and aesthetics, that is functional for the production of articles for domestic and/or industrial use, solving the inconveniences of the devices known to the state of the art.

The purpose of the present invention is to create a mechanical device to facilitate a tightening closure of articles and fashion accessories or daily objects of both domestic and industrial use, making the closure practical, quick and easy by simply overlapping the parts and without these rotating one with respect to the other, rotating only the central plate structured in the housing part of the device The purpose of this invention is to create a mechanical device capable of ensuring robust sealing thanks to clamping, easily and without requiring a particular pressure to trigger the closure itself, making the device practical and useful even when applied in electrical, mechanical and/or hydraulic fields as junction shall be used.

Another purpose of this invention is to make a mechanical device of tightening closure, that in its decorative structure of articles and fashion accessories, or daily objects for domestic and industrial use, that can also have a thickness of a few millimeters, being much reduced compared to the devices known in the state of the art.

Another purpose of this invention is to realize a device that, is composed to a removable component that can be interchanged and customized, on a line of objects that present the same technical structure, in a practical and fast way.

Another purpose of this invention is to offer n mechanical device, for any purpose used, that present a technical functionality and a high aesthetic value with a low cost of production.

Another purpose of the present invention is to realize a mechanical device that, depending on the utilization, can be realized in different shape, size and material.

These and other purposes are realized by the invention and result from the following description that illustrates some preferred forms of realization, to be understood as an example and not a limitation, in the figures below.

BRIEF DESCRIPTION OF DRAWINGS

The figures below show examples of some forms and fields of application of the present invention, which may usefully fulfil the function of tightening closure in different fields of the state of the art (e.g. in the fashion field, as a locking device or decorative component applied to clothing and accessories; in the domestic field; in the hydraulic, mechanical and electrical field as a junction device).

in FIG. 3 pin and housing areas have an hexagonal shape;

in FIG. 4 pin and housing areas have a form of an heart;

Figure 1:
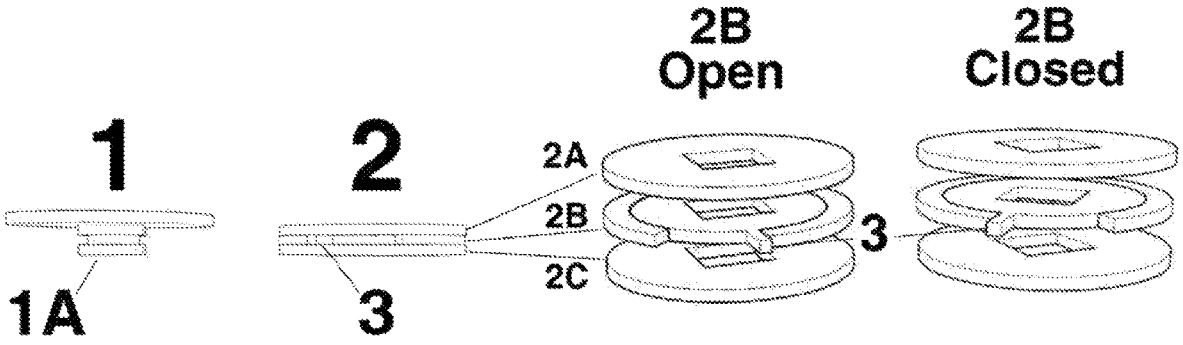
FIGS. 1 and 2—illustrate a first form of realization of this invention as multipurpose mechanical devise with technical function of tightening closure composed of two parts: one of the two is composed of a plate interchangeable and customizable that contains a pin (1A); the other part of housing (2) which is composed of minimum three plates with housing (2A-2B-2C), each containing the same housing area, joined together to create a single part (2) with a single housing area (2*a*) suitable to cover the pin (1A); the central plate (2B) of the housing part (2) is structured to contain a lever (3) which rotates up to stop, also with a spring (4), inside of the two plates 2A and 2C; the pin (1A) included in the other part of the device (1), inserted within the housing area (2*a*) of the housing part (2), is locked by the rotation of the lever (4), incorporated in the central plate 2B, up to stop, so ensuring the tightening closure of the two parts of the device (as shown in FIG. 2).
Figure 2:
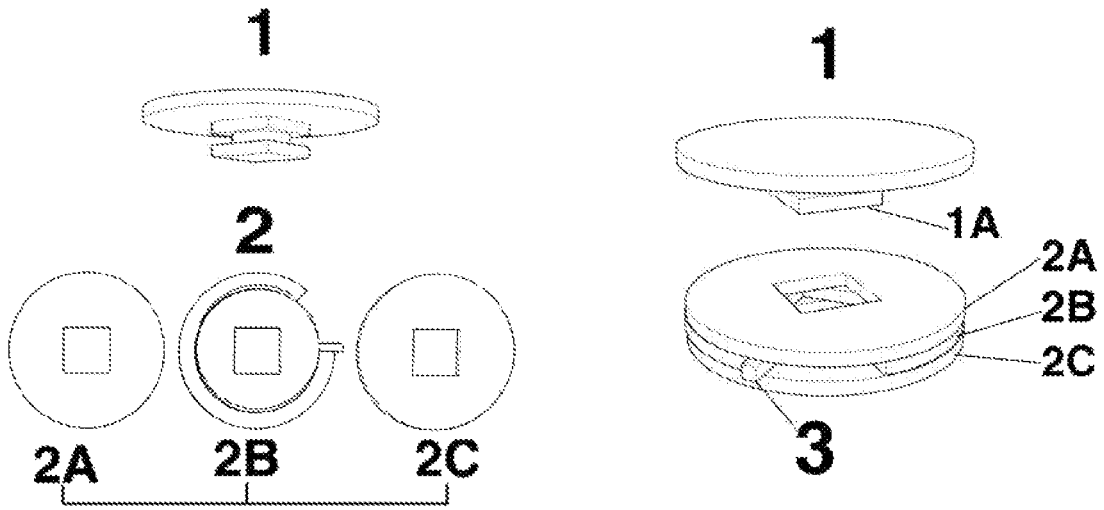
Figure 3:
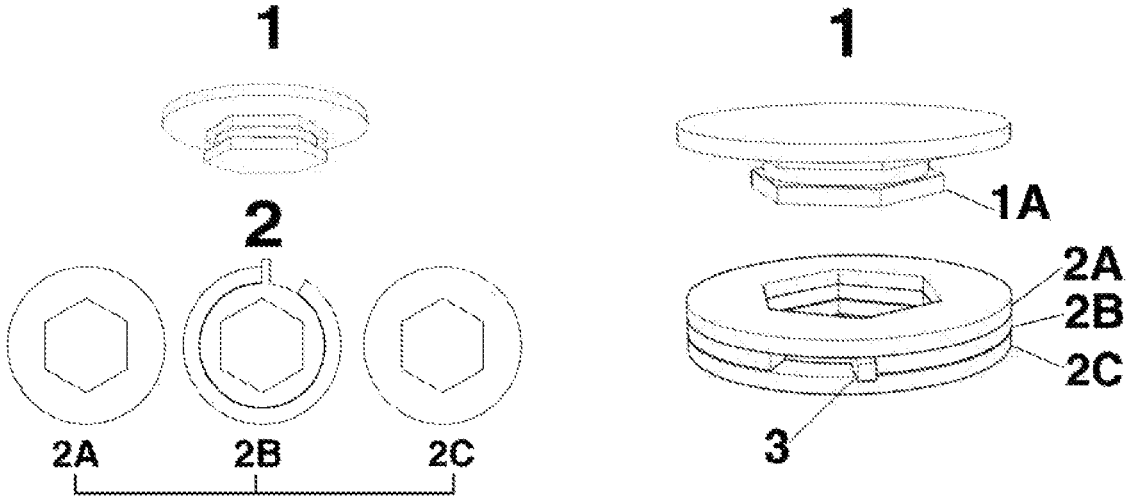
FIGS. 3 and 4 illustrate, as an example, different forms of implementation of the present mechanical device/which is composed of the same characteristics and operation of the device illustrated in FIGS. 1 and 2, presenting it with a pin and housing areas of different shape and, specifically.
Figure 4:
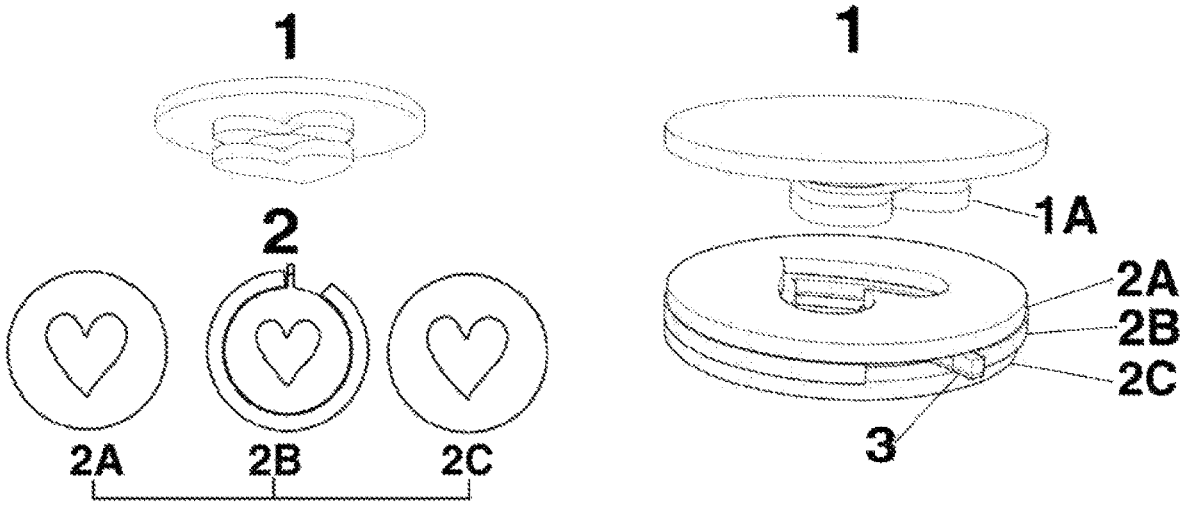
Figure 5:
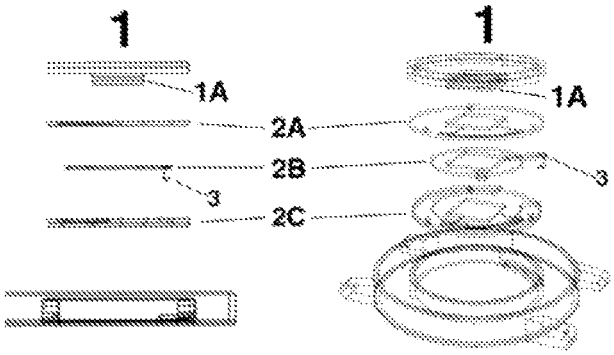
FIG. 5 shows the Applicant's device used for the creation of a wristwatch to allow the application of new technologies.
Figure 6:
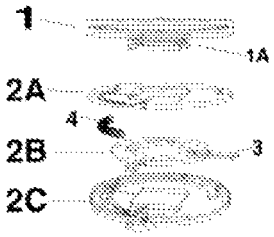
FIG. 6 shows the Applicant's device used for the creation of a bracelet to allow the application of new technologies.

The variants of realization, as described above, shall be understood as for example only, being the Applicant's device functional to be adapted for further realizations, shape, applications and uses in each mechanical field in order to obtain a tightening closure between two part, overcoming the limits of the patents known today.

The invention claimed is:

1. A mechanical closure and fastening device, comprising:

a first part, comprising a plate with a pin extending therefrom, the pin comprising first and second shaped sections in registry alignment and a narrower engaging section therebetween; and a second part, comprising first, second and third plates, joined together with the second plate between the first and third plates, each plate having an opening in registry alignment and shaped to receive the first and second shaped sections when said pin is inserted thereinto;

wherein said second plate comprises a rotatable plate within a fixed housing, and having a lever with which the rotatable plate is rotated between an open position and a tightened, locked position within the housing, wherein in the tightened, locked position the opening in the rotatable plate is rotated out of registry alignment with the openings in said first and third plates;

and wherein when the rotatable plate is in the open position, and the pin is inserted into the openings, the first and second shaped sections of said pin are fixedly engaged by the openings in said first and third plates, and the engaging section therebetween is aligned with the opening in said second plate, the rotatable plate is rotated with the lever about the engaging section to the tightened, locked position to thereby capture the first shaped section and lock the first and second parts together.

2. The device according to the claim 1 where the second plate further comprises a spring, to bias the rotatable plate in the tightened, locked position.

3. The device according to claim 1, in which the openings in the first, second and third plates are the same shape as the first and second shaped sections of the pin.

4. The device according to claim 1, where the shaped sections of the pin and the openings in the first, second and third plates are any shape other than a circle.

5. The device according to claim 1, wherein the shaped sections and openings have a shape selected from the group consisting of a square, hexagon, heart, symbol, logo, letter, number, and sign.

6. The device according to claim 1, wherein the shaped sections and openings have a shape selected from the group consisting of a square, hexagon, and heart.

7. The device according to claim 1, wherein the pin further comprises a plurality of shaped sections and only a single engaging section, and wherein the second part comprises a plurality of openings and only a single rotatable plate within a housing.

* * * * *